US005335150A

United States Patent [19]

Huang

[11] Patent Number: 5,335,150

[45] Date of Patent: Aug. 2, 1994

[54] LASER POINTER WITH A CONSTANT POWER OUTPUT CONTROL

[76] Inventor: Chao C. Huang, 10F, No. 185, Yung Chi Rd., Taipei, Taiwan

[21] Appl. No.: 113,670

[22] Filed: Aug. 31, 1993

[51] Int. Cl.[5] ..... B43K 29/10

[52] U.S. Cl. ..... 362/118; 362/259; 362/109; 362/253; 362/32; 362/800

[58] Field of Search ..... 362/118, 109, 259, 154, 362/253, 102, 32, 157, 208, 205, 800

[56] References Cited

U.S. PATENT DOCUMENTS

| | | | |
|---|---|---|---|
| D. 329,059 | 9/1992 | Lee | D19/59 |
| D. 332,965 | 2/1993 | Wu et al. | D19/59 |
| 4,687,918 | 8/1987 | Hughes et al. | 250/205 |
| 4,761,715 | 8/1988 | Brooks | 362/23 |
| 4,926,438 | 5/1990 | Maes et al. | 372/109 |
| 4,964,024 | 10/1990 | Tsay | 362/118 |
| 5,193,897 | 3/1993 | Halsey | 362/118 |
| 5,268,829 | 12/1993 | Lo | 362/109 |

*Primary Examiner*—Larry Jones
*Attorney, Agent, or Firm*—Browdy and Neimark

[57] ABSTRACT

A laser pointer is disclosed consisted of a laser module, a housing, a toggle switch, a push button, a constant power output control circuit, a ballpoint pen, a battery set, and a rotary cap, wherein the housing has chambers to hold the laser module, the battery set, and the push button ballpoint pen, and a clip for hanging; the toggle switch has a press rod controlled by a button to press a leaf spring on a PC board so as to electrically connect the battery set to the laser module in driving the laser module to emit a laser beam for pointing to things.

3 Claims, 8 Drawing Sheets

(B)

(A)

LASER POINTER WITH A CONSTANT POWER OUTPUT CONTROL

BACKGROUND OF THE INVENTION

The present invention relates to laser pointers, and more particularly to a pen-like laser pointer with a constant power output control used for pointing to things on a map, chart, blackboard, etc., by means of the laser beam generated thereby.

Various laser pointers have been disclosed, and have appeared on the market. These laser pointers are commonly comprised of a metal casing having a laser diode connected to a trigger circuit thereof and controlled by a press contact switch to generate a laser beam for pointing to things on a map, chart, blackboard, etc. As the press contact switch is fastened to the rear end of the casing, it may be easily triggered by error. Furthermore, the use of the metal casing greatly increases the cost of this laser pointer.

SUMMARY OF THE INVENTION

The present invention eliminates the aforesaid disadvantages of the prior art laser pointers. It is therefore an object of the present invention to provide a laser pointer which prevents the laser diode thereof from being triggered by error. It is another object of the present invention to provide a housing for a laser pointer which is an ergonomic mechanic design for comfortable and positive holding with the hand. It is another object of the present invention to provide a laser pointer which is combined with a press button ballpoint pen for writing. It is still another object of the present invention to provide a constant power output circuit for a laser pointer which provides a constant output voltage to the laser module.

According to the present invention, the laser pointer is consisted of a housing to hold a laser module, a battery set, and a push button ballpoint pen. The housing of the laser pointer is consisted of an upper shell and a bottom shell respectively made from a plastic material through the process of injection molding and connected to each other through a welding process by an ultrasonic welding apparatus. The laser module is controlled by a toggle switch to generate a laser beam for pointing. The toggle switch is consisted of a button, a printed circuit board, and an elongated spring strip. The button has an extension strip at one end for automatic return control, and a press rod within a bottom hole thereof pressed by the button to connect the printed circuit board. The printed circuit board has one end connected to the laser module by a leaf spring and a cable and an opposite end connected to the battery set by the elongated spring strip through a rotary cap, which is fastened to the rear end of the housing.

DETAILED DESCRIPTION OF THE PREFERRED EMBODIMENT

Figure 1:
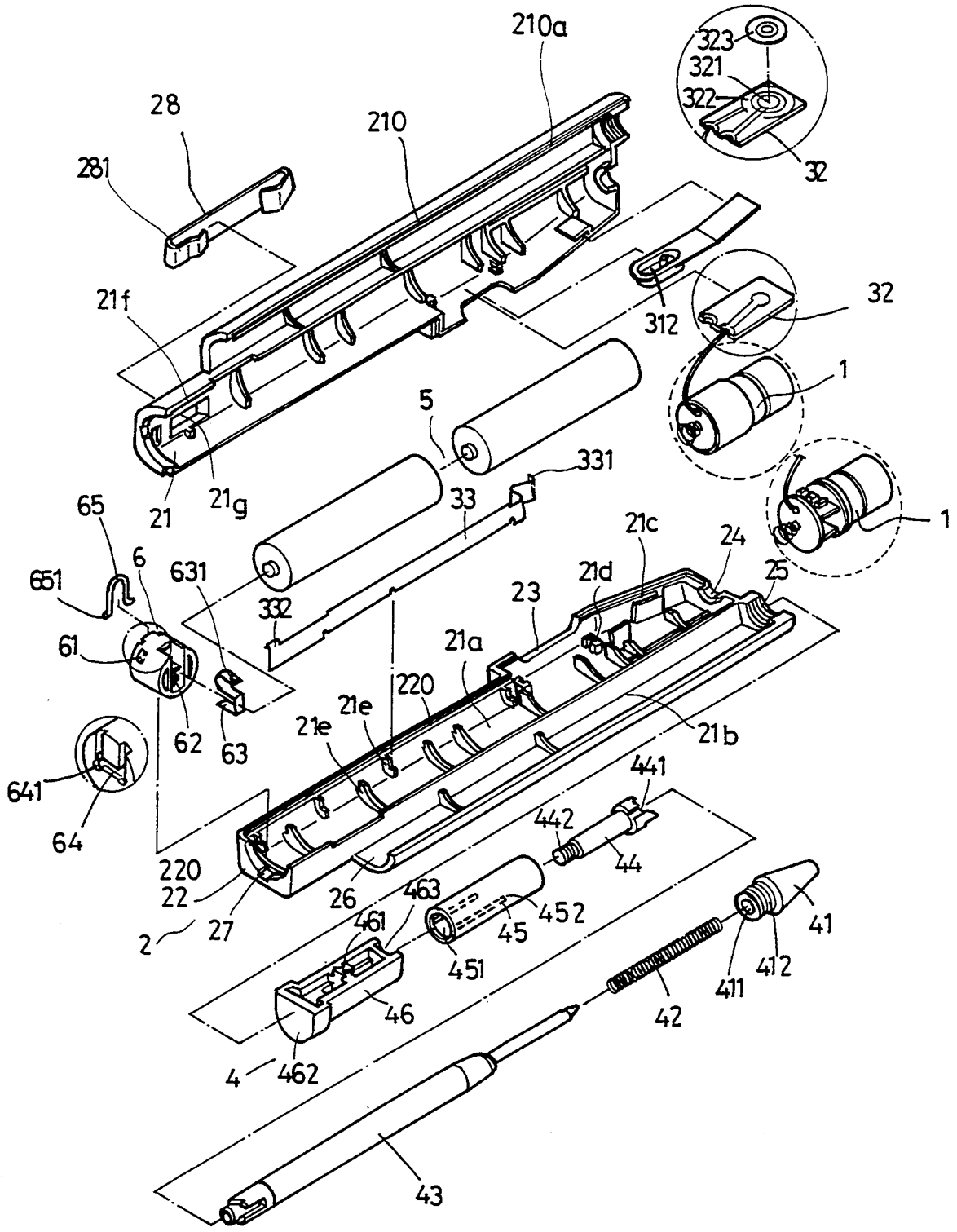
FIG. 1 is an exploded view of a laser pointer according to the preferred embodiment of the present invention.
Figure 2:
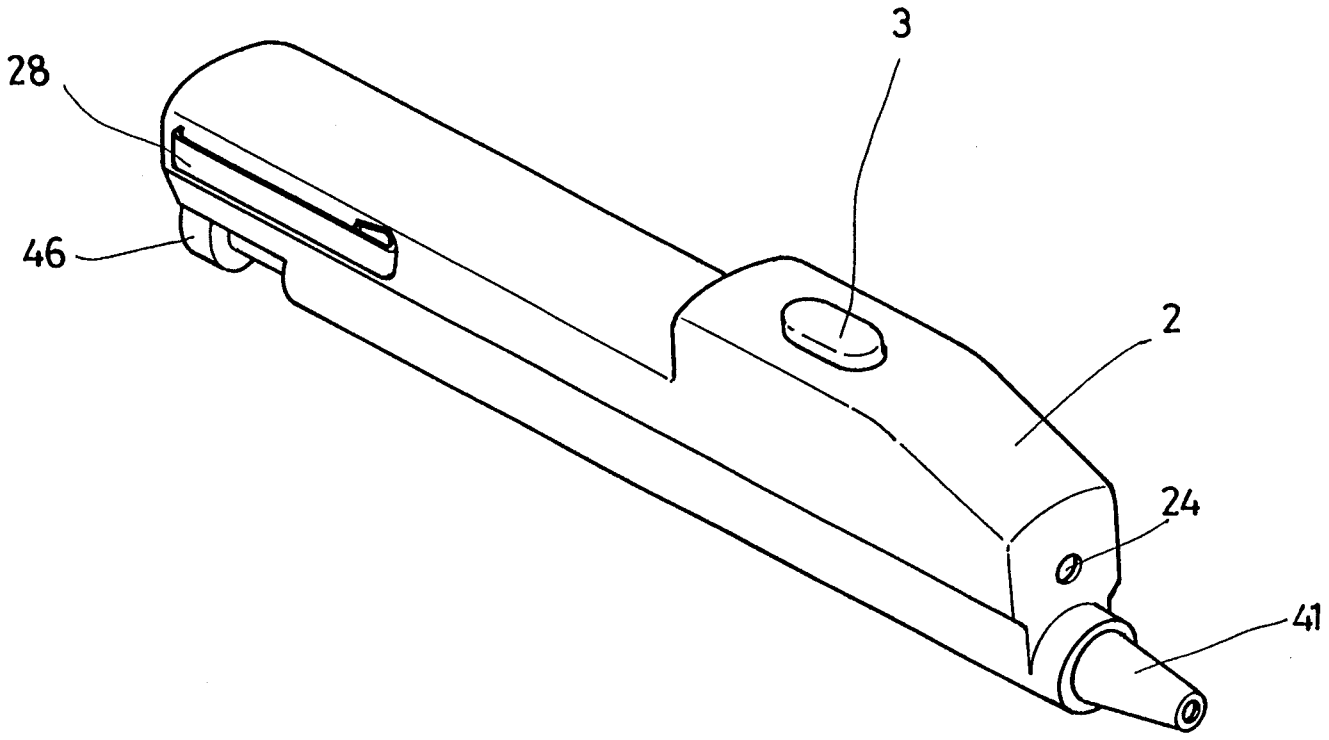
FIG. 2 is an elevational view of the laser pointer.
Figure 3:
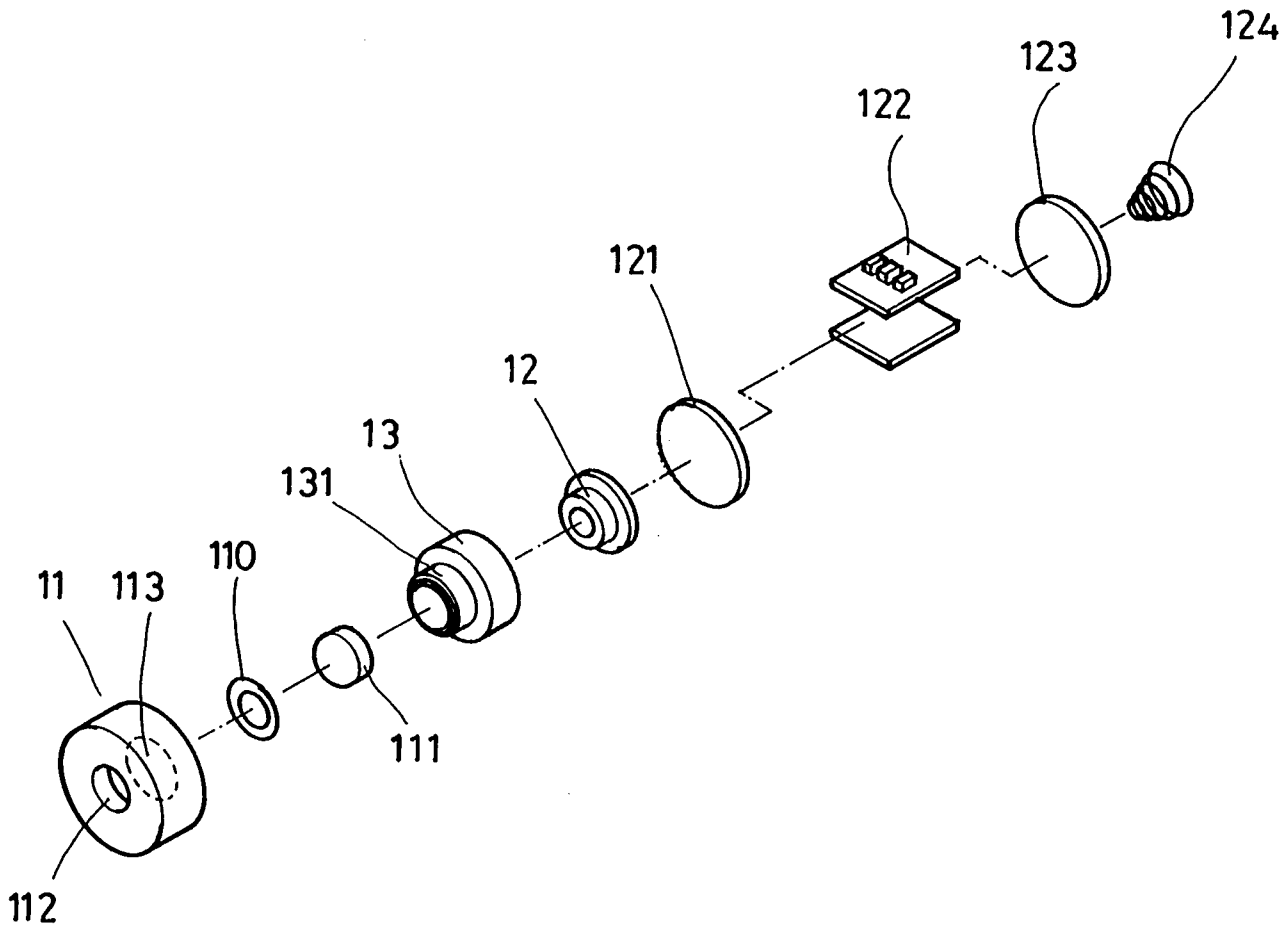
FIG. 3 is an exploded view of the laser module of the laser pointer.
Figure 4:
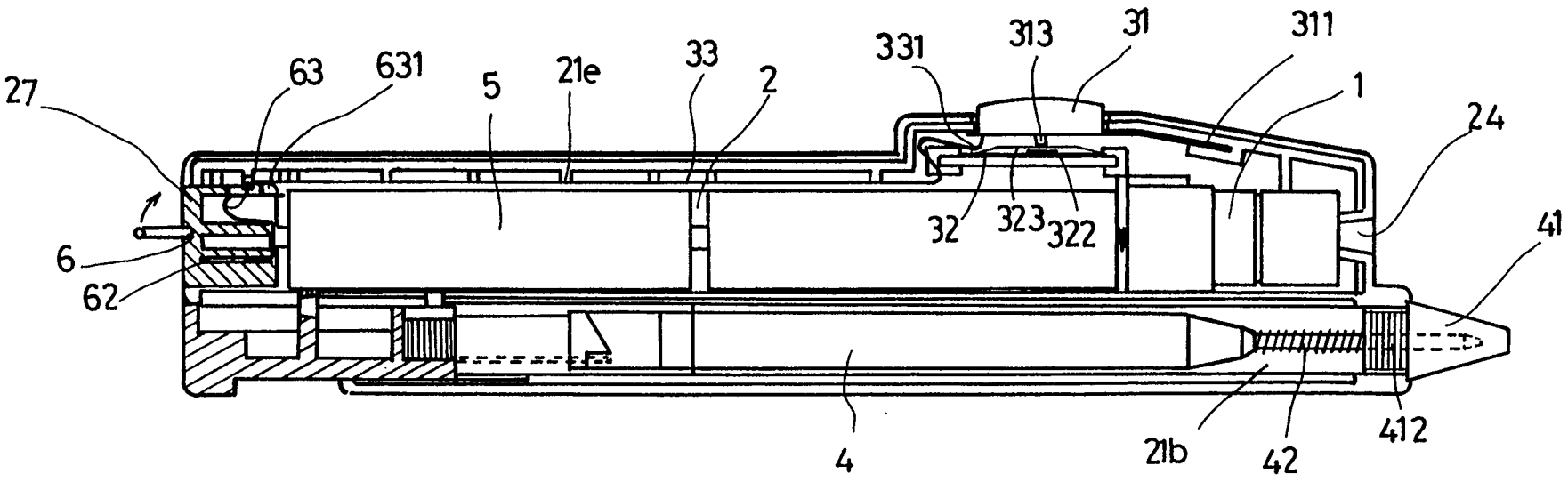
FIG. 4 is a longitudinal cross section of the laser pointer.

Referring to FIGS. 1, 2, 3, and 4, a laser pointer as constructed in accordance with the present invention is generally comprised of a laser module 1, a housing 2, a toggle switch 3, a push button ballpoint pen 4, a battery set 5, and a rotary cap 6.

The laser module 1 is comprised of a lens assembly 11, a laser diode 12, and a diode holder 13. The lens assembly 11 comprises a plastic lens 111 fastened in a bore 113 thereof by an O-ring 110 in line with a front projecting hole 112 thereof. The laser diode 12 is inserted in the diode holder 13. The contact pins of the laser diode 12 are directly welded to a trigger circuit board 121. The trigger circuit board 121 is connected to a rear PC board 123 through two vertically spaced constant power output control PC boards 122. The negative terminal of the rear PC board 123 is connected to a metal contact conical spring 24. The positive terminal of the trigger circuit board 121 is connected to a PC board 32. Alternatively, the constant power output control PC boards 122 may be eliminated for allowing the negative terminal of the trigger circuit board 121 to be directly connected to the metal contact conical spring 124, and the positive terminal thereof to be connected to the PC board 32. The diode holder 13 has a tubular front projection 131 fitted into the bore 113 to hold the plastic lens 111 in place. As the lens assembly 11 and the diode holder 13 are connected together, the plastic lens 111 is firmly retained between th O-ring 110 and the tubular front projection 131 of the diode holder 13. Therefore, the focus between the front end of the tubular front projection 131 and the laser diode 12 is the focus of the diode holder 13, and the length of the tubular front projection 133 of the diode holder 13 is determined according to the focus of the plastic lens 111. Once the lens assembly 11 and the diode holder 13 were been tightly connected together, the focus is fixed. Because the plastic lens 111 is firmly attached to the tubular front projection 131 of the diode holder 13, error in concentricity is eliminated. Therefore, the laser module 1 provides good light condensing effect.

The housing 2 is consisted of two symmetrically shells, namely, the upper shell 21 and the bottom shell 22 that are made of plastics through an injection molding process. The upper shell 21 has a peripheral flange 210 engaged into a peripheral groove 220 on the bottom shell 22, and a welding strip 210*a* along the peripheral flange 210 welded to a welding strip 220*a* along the peripheral groove 220 by an ultrasonic welding apparatus. When assembled, the housing 2 defines therein a first chamber 21*a*, which receives the laser module 1 and the battery set 5, a second chamber 2l*b*, which receives the push button ballpoint pen 4, a third chamber 21*c*, which receives the toggle switch 3. The housing 2 also comprises symmetrical retaining grooves 21*d* and retaining notches 21*e* on the inside, an inside opening 21*f* between the first and second chambers 21*a*, 21*b* at one end, a toggle switch slot 23 in communication with the third chamber 21*c*, a projecting hole 24 at one end of the first chamber 21*a*, a screw hole 25 at one end of the second chamber 21*b*, a rear opening 26 at an opposite end of the second chamber 21*b*, an end hole 27 at an opposite end of the first chamber 21*a* into which the rotary cap 6 fits, two opposite grooves 271 inside the end hole 27 through which two opposite lock keys 61 on the rotary cap 6 pass, and a clip slot 21*g* on the upper shell 21 adjacent to the end hole 27 on which a hook 281 of a clip 28 hooks.

The toggle switch 3 is comprised of a button 31, a PC board 32, and an elongated spring strip 33. The button 31 comprises an extension strip 311 at one end, and a press rod 313 within a bottom hole 312 thereof. The PC board 32 comprises a first copper loop 321, a second copper loop 322 surrounding the first copper loop 321, and a metal contact leaf spring 323 connected to the first copper loop 321. The leaf spring 323 has an opposite end connected to the laser module 1 by a cable. The elongated spring strip 33 comprises a first hook 331 and a second hook 332 on two opposite end thereof controlled by the button 31 to close the circuit for permitting the battery set 5 to be electrically connected to the laser module 1.

The push button ballpoint pen 4 is comprised of a front socket 41, a compression spring 42, a reservoir tube 43, a thrust axle 44, a sleeve 45, and a push button 46. The front socket 41 comprises a center through hole 411 through the length, through which the point of the reservoir tube 43 passes, and an externally threaded stub tube 412 threaded into the screw hole 25 on the housing 2. The reservoir tube 43 is an ordinary product that can be easily obtained from the market. The thrust axle 44 has a pawl 441 at one end, which catches the top end of the reservoir tube 43, and a screw rod 442 at an opposite end, which inserts through the bore 451 of the sleeve 45 and threads into a screw hole 463 on the bottom of the push button 46. The sleeve 45 comprises two longitudinal rails 45 symmetrically disposed on the inside to guide the thrust axle 44 for permitting it to be moved in the longitudinal direction. The push button 46 comprises a H-shaped flange 461 for positioning, a flat top end 462 for pressing with the thumb, and a screw hole 463 on the bottom thereof into which the screw rod 442 inserts.

The battery set 5 is comprised of two 1.5 V battery cells.

The rotary cap 6 comprises two opposite lock keys 61, which are moved through the grooves 271 and then locked inside the end hole 27 of the housing 2 through a rotary motion, and a contact spring 63 fastened inside a bottom hole 62 thereof. The contact spring 63 comprises a circular flange 631 raised near one end thereof. After the rotary cap 6 was locked in place, the circular flange 631 is disposed in contact with the second hook 332 of the elongated spring strip 33. Further, the rotary cap 6 comprises a retaining groove 64 on an outer side thereof, two plug holes 641 symmetrically spaced at the bottom, and a substantially U-shaped finger rod 65 having two opposite ends 651 inserted through the retaining groove 64 and fitted into the plug holes 641. The U-shaped finger rod 65 is provided for turning the rotary cap 6 with the fingers.

Referring to FIGS. 2 and 4 again, the push button ballpoint pen 4 is fastened inside the second chamber 21*b*, the extension strip 311 of the button 31 and the PC board 32 and spring strip 33 of the toggle switch 3 are placed in the third chamber 21*c* and respectively fastened in the retaining grooves 21*d* and retaining notches 21*e*, then the upper shell 21 is fastened to the bottom shell 22 and the battery set 5 is inserted through the end hole 27 into the first chamber 21*a*, and then the rotary cap 6 is fastened in the end hole 27 with the contact spring 63 stopped against the positive terminal of the battery set 5 for permitting the circular flange 631 of the contact spring 63 to be disposed in contact with the second hook 332 of the elongated spring strip 33.

Figure 5:
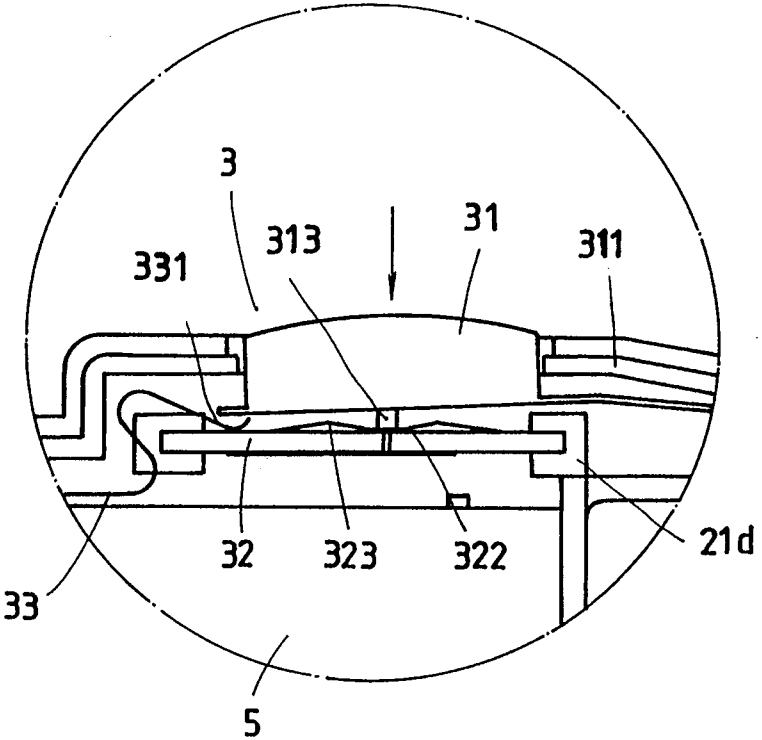
FIG. 5A illustrates the toggle switch of the laser pointer released to cut off the circuit.
FIG. 5B illustrates the toggle switch of the laser pointer depressed to connect the circuit.
Figure 5:
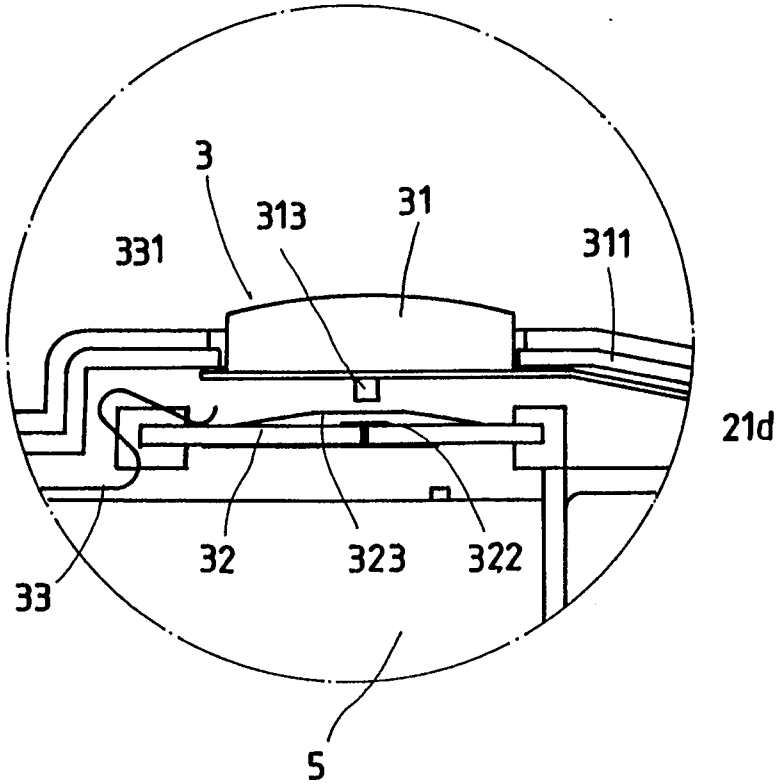

Referring to FIGS. 5A and 5B, as the button 31 is depressed, the extension strip 311 provides a spring force to move the press rod 313 causing it to press against the leaf spring 323 of the PC board 32 in connecting the second copper loop 322 electrically, and therefore the trigger circuit board 131 of the laser module 1 is electrically connected to trigger the laser diode 12, causing the laser diode 12 to emit a laser beam for pointing.

Figure 6:
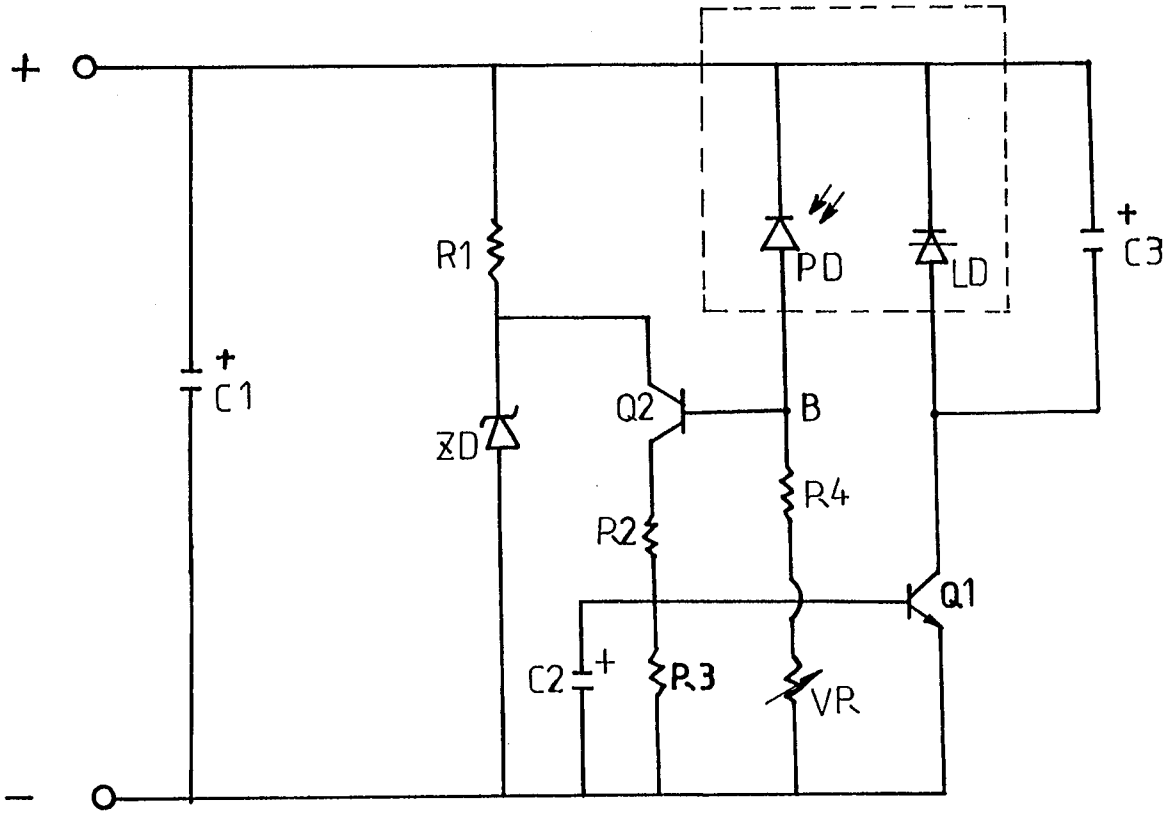
FIG. 6 is a circuit diagram according to the present invention.

Referring to FIG. 6, therein illustrated is a circuit diagram of the laser pointer. Basically, the circuit is a constant current control circuit. Transistor Q1 stabilizes electric current to laser diode LD. Laser diode LD emits a laser beam. Photoelectric diode PD receives the laser beam and then provides a feedback reference. Electric current to laser diode LD is controlled by transistor Q1, which is further controlled by transistor Q2. Transistor Q2 and 2.5 V zener diode ZD provide a reference voltage (2.5 V), and form a constant current source. Photoelectric diode PD is connected to the base B of transistor Q2 to provide a negative feedback for stabilizing the circuit. There are two possible reasons which cause variations of output power. One reason is that input working voltage is changed. Because zener diode resists against change of working voltage, constant current does not change, and therefore output power is constantly maintained. The other reason is that the change of the working temperature of laser diode LD causes change of output power. Because photoelectric diode PD detects feedback of output power, compensation can be done, and therefore a constant output is achieved.

Figure 7:
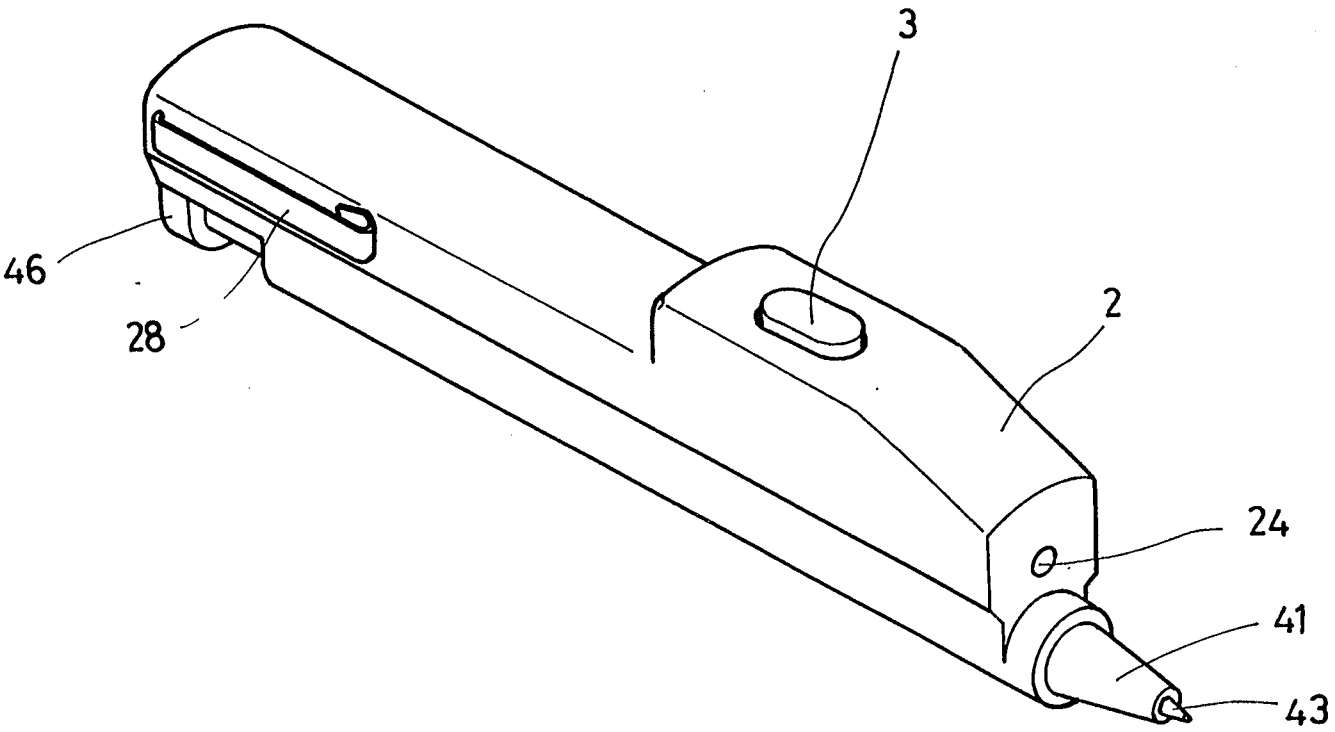
FIG. 7 illustrates the push button ballpoint pen of the laser pointer pressed into the operative position for writing.
Figure 8:
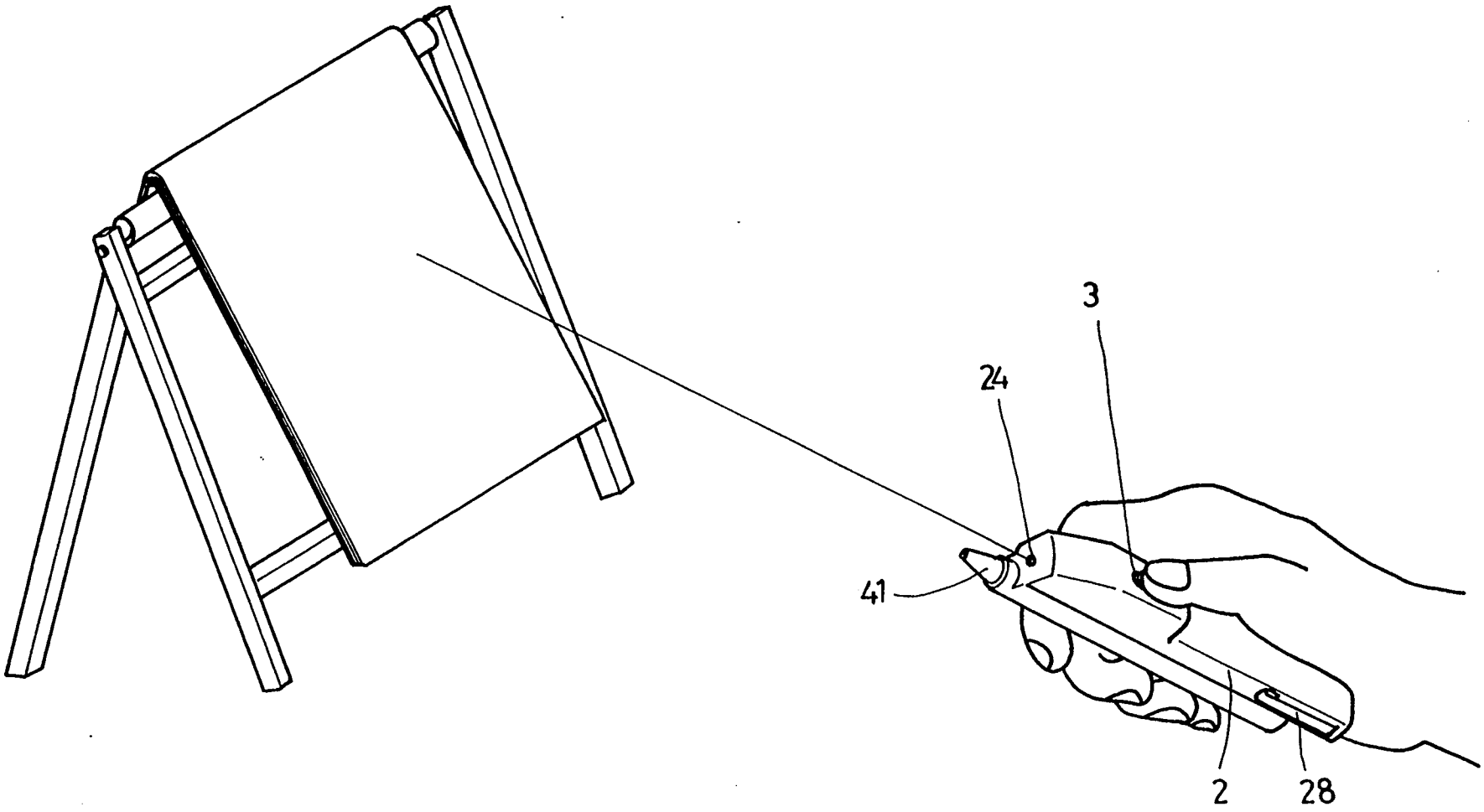
FIG. 8 illustrates the laser pointer triggered to emit a laser beam onto a chart for pointing.

Referring to FIGS. 7 and 8, the push button ballpoint pen 4 is used for writing; the toggle switch 3 is switched to cause the laser module to emit a laser beam for pointing to things on a map, etc.

While only an embodiment of the present invention has been shown and described, it will be understood that various modifications and changes could be made without departing from the spirit and scope of the invention.

I claim:

1. A laser pointer comprised of a laser module, a laser module, a housing, a toggle switch, a push button ballpoint pen, a battery set, and a rotary cap, wherein:

said laser module is comprised of a lens assembly, a laser diode, a diode holder, and a trigger circuit board, said lens assembly comprising a plastic lens fastened in a bore thereof by an O-ring and disposed in line with a front projecting hole thereof, said diode holder comprising a front tube fitted into said bore and stopped at said plastic lens against said O-ring, a laser diode, said laser diode being electrically connected to said trigger circuit board by a soldering process, said trigger circuit board being electrically connected to said toggle switch;

said housing is comprised of an upper shell and a bottom shell respectively made of a plastic material through the process of injection molding, said upper shell comprising a peripheral flange inserted in a peripheral groove on said bottom shell, and a peripheral welding strip welded to a peripheral welding strip on said bottom shell, said housing comprising a first chamber, which receives said laser module and said battery set, a second chamber, which receives said push button ballpoint pen, a third chamber, which receives said toggle switch, a toggle switch slot in communication with said third chamber, a projecting hole at one end of said first chamber, a screw hole at one end of said second chamber, a rear opening at an opposite end of said second chamber, an end hole at an opposite end of said first chamber into which said rotary cap fits, two opposite grooves inside the end hole through which two opposite lock keys on said rotary cap pass, and a clip slot on said upper shell adjacent to said end hole to hold a clip;

said toggle switch is comprised of a button, a printed circuit board, and an elongated spring strip, said button having an extension strip at one end for automatic return control, and a press rod within a bottom hole thereof, said printed circuit board having one end connected to said laser module by a leaf spring and a cable and an opposite end connected to said battery set by said elongated spring strip through said rotary cap;

said push button ballpoint pen is comprised of a front socket, a reservoir tube, a thrust axle, a sleeve, and a push button, said front socket comprising a center through hole through the length and an externally threaded stub tube at one end threaded into the screw hole on said housing, said thrust axle comprising pawl at one end, which catches said reservoir tube, and a screw rod at an opposite end inserted through said sleeve and threaded into a bottom screw hole on said push button, said sleeve comprising two longitudinal rails on the inside for guiding said thrust axle to move in the longitudinal direction, said push button comprising a H-shaped flange for positioning, a screw hole into which the screw rod of said thrust axle is threaded, and a flat top end for pressing with the thumb; and said rotary cap comprises two opposite lock keys, which pass through the grooves inside said end hole and then are locked inside said end hole through a rotary motion, a contact spring fastened inside a bottom hole thereof, a retaining groove on an outer side thereof, two plug holes symmetrically spaced at the bottom, and a substantially U-shaped finger rod provided for turning said rotary cap with the fingers, said finger rod having two opposite ends inserted through the retaining groove of said rotary cap and fitted into said plug holes, the contact spring of said rotary cap being connected to said battery set and comprising a circular flange disposed in contact with said elongated spring strip of said toggle switch.

2. The laser pointer of claim 1 which further comprises a constant power output control circuit electrically connected between said trigger circuit board and said toggle switch to provide a constant voltage to said trigger circuit board.

3. The laser pointer of claim 1 wherein said clip is integrally molded on said housing.

* * * * *